US012680773B2

(12) United States Patent
Dubois et al.

(10) Patent No.: US 12,680,773 B2
(45) Date of Patent: Jul. 14, 2026

(54) BUFFERED BOLT CATCH

(71) Applicant: Smith & Wesson Inc., Maryville, TN (US)

(72) Inventors: Jason Dubois, North Smithfield, RI (US); Brett Curry, Monson, MA (US)

(73) Assignee: Smith & Wesson Inc., Maryville, TN (US)

( * ) Notice: Subject to any disclaimer, the term of this patent is extended or adjusted under 35 U.S.C. 154(b) by 123 days.

(21) Appl. No.: 18/512,303

(22) Filed: Nov. 17, 2023

(65) Prior Publication Data

US 2024/0263901 A1 Aug. 8, 2024

Related U.S. Application Data

(60) Provisional application No. 63/426,592, filed on Nov. 18, 2022.

(51) Int. Cl.
*F41A 17/36* (2006.01)
*F41A 3/72* (2006.01)

(52) U.S. Cl.
CPC ..... *F41A 17/36* (2013.01); *F41A 3/72* (2013.01)

(58) Field of Classification Search
CPC ..... F41A 17/36; F41A 3/72
See application file for complete search history.

(56) References Cited

U.S. PATENT DOCUMENTS 2,365,389 A 12/1944 Browning
4,549,465 A 10/1985 Charron
7,228,780 B1 * 6/2007 Thomele ..... F41A 17/42 89/190
7,395,747 B2 7/2008 Murello
8,015,742 B2 9/2011 Zedrosser
8,479,635 B2 7/2013 Overstreet et al.
8,701,324 B1 * 4/2014 Viani ..... F41A 17/36 42/16
9,482,480 B2 11/2016 O'Dell
9,719,742 B2 8/2017 Zeman
9,915,490 B2 * 3/2018 Gentilini ..... F41A 19/10
9,933,222 B2 * 4/2018 Hirschheiter ..... F41A 17/36
9,952,011 B2 4/2018 Overstreet et al.
10,330,407 B2 6/2019 Iwasawa
10,415,912 B2 * 9/2019 Iwasawa ..... F41A 17/36
2002/0194762 A1 * 12/2002 Cominolli ..... F41A 17/72 42/70.06
2005/0000138 A1 1/2005 Kiss
(Continued)

*Primary Examiner* — Joshua E Freeman
(74) *Attorney, Agent, or Firm* — Ballard Spahr LLP

(57) ABSTRACT

A bolt catch is movably mounted on a firearm. A first surface of the bolt catch is configured to engage a bolt to retain the bolt in a first position. The bolt catch has a second surface that is configured to engage a follower of a magazine when the magazine is empty to position the bolt catch in a catching configuration in which the first surface is within a path of travel of the bolt. The bolt catch includes an elongate slot that extends transversely through the bolt catch. A pin extends through the slot of the bolt catch. The bolt catch is configured to pivot about the pin and slide relative to the pin. A spring biases the bolt catch rearwardly. Upon engagement between the bolt and the first surface of the bolt catch, the bolt catch is configured to slide relative to the pin to compress the spring.

17 Claims, 4 Drawing Sheets

(56) References Cited

U.S. PATENT DOCUMENTS

| | | | | |
|---|---|---|---|---|
| 2014/0338243 | A1* | 11/2014 | La Vigne | F41A 35/06<br>42/16 |
| 2016/0320155 | A1* | 11/2016 | Singh | F41A 17/72 |
| 2017/0241729 | A1* | 8/2017 | Gangl | F41A 3/66 |
| 2018/0112944 | A1* | 4/2018 | Underwood | F41A 17/28 |
| 2018/0259281 | A1* | 9/2018 | Indruch | F41A 17/38 |
| 2019/0033028 | A1* | 1/2019 | Folk | F41A 19/10 |
| 2019/0195582 | A1* | 6/2019 | Thomele | F41A 7/00 |
| 2021/0164747 | A1* | 6/2021 | Denson, III | F41A 9/59 |
| 2021/0247155 | A1* | 8/2021 | Roberts | F41A 9/70 |
| 2021/0372725 | A1* | 12/2021 | Gibbens | F41A 17/36 |
| 2023/0304753 | A1* | 9/2023 | Tai | F41A 3/64 |
| 2023/0324136 | A1* | 10/2023 | Tai | F41A 3/10<br>42/14 |
| 2024/0240906 | A1* | 7/2024 | Palanques-Fleck | F41A 3/78 |
| 2025/0060178 | A1* | 2/2025 | Hell | F41A 17/64 |

* cited by examiner

BUFFERED BOLT CATCH

CROSS-REFERENCE TO RELATED APPLICATION

This application claims priority to and the benefit of the filing date of U.S. Provisional Patent Application No. 63/426,592, filed Nov. 18, 2022, the entirety of which is hereby incorporated by reference herein.

FIELD

This disclosure relates to bolt catches for firearms.

BACKGROUND

It is advantageous that the bolt of a semiautomatic firearm, such as a rifle, be held out of battery in an open position after the last cartridge has been expended. The bolt, held out of battery, immediately alerts the shooter that the magazine is empty and that it is time to reload. However, for some firearms, the bolt is not held open after the last round is fired, but is permitted to run back to battery under the biasing force of its recoil spring. For example, for certain firearms, the bolt has significant kinetic energy upon its return that would damage a conventional bolt catch that merely pivots about a pin, so the bolt catch is not included.

There is clearly an opportunity to improve the operation of such firearms by providing a bolt catch that can withstand impact of the bolt without sustaining damage.

SUMMARY

Aspects of this disclosure concern a firearm having a buffered bolt catch. In an example embodiment, the firearm having a longitudinal axis comprises a bolt configured for reciprocal motion about and between a first position and a second position along a path of travel along the longitudinal axis. The bolt has a forward surface. The forward surface of the bolt is in a first location along the longitudinal axis when the bolt is in the first position, and the forward surface of the bolt is in a second location along the longitudinal axis when the bolt is in the second position. The first location of the forward surface of the bolt is spaced in a first direction along the longitudinal axis from the second location of the forward surface of the bolt. A bolt catch is movably mounted on the firearm. The bolt catch comprises a first surface that is configured to engage the bolt to retain the bolt in the first position. The bolt catch further comprises a second surface that is configured to engage a follower of a magazine when the magazine is empty to position the bolt catch in a catching configuration in which the first surface is within the path of travel of the bolt between the first position and the second position. The bolt catch comprises an elongate slot that extends transversely through the bolt catch. A pin extends through the slot of the bolt catch. The bolt catch is configured to pivot about the pin and slide relative to the pin. A spring biases the bolt catch in the first direction. Upon engagement between the bolt and the first surface of the bolt catch, the bolt catch is configured to slide relative to the pin to compress the spring.

In one example, the second surface of the bolt catch is a rear surface of the bolt catch. The forward surface of the bolt catch is configured to engage the rear surface of the bolt catch.

In a particular example, the spring is further configured to bias the bolt catch to a stowed configuration in which the first surface of the bolt catch is outside of the path of travel of the bolt. The bolt catch comprises a forward surface, the forward surface having a first portion and a second portion. The first portion is spaced vertically above the pin along a vertical axis and spaced forwardly of the second portion so that only the first portion is configured to bias against the spring when the bolt catch in the stowed configuration.

In an example embodiment, the first surface of the bolt catch is spaced from the pin in the first direction along the longitudinal axis.

In a specific example, the bolt catch is a unitary structure. For example, in one aspect, the bolt catch is formed from stamped metal.

In an example embodiment, when the bolt catch is in the catching configuration, the slot is parallel to, or generally parallel to (e.g., within 5 degrees or 10 degrees of being parallel to), the longitudinal axis.

In an example, the bolt catch comprises an inwardly extending tab that defines the second surface.

In one embodiment, the firearm further comprises a sleeve that at least partially surrounds the spring. The sleeve is disposed between, and in contact with, the bolt catch and the spring.

In one example, the firearm further comprises a grip body. The bolt catch comprises at least one protrusion that extends outwardly from the grip body to permit a user to move the bolt catch. By way of example, the at least one protrusion comprises opposed protrusions that extend from opposite sides of the grip body.

In one aspect, the firearm is a carbine.

In one particular example, the firearm comprises the magazine comprising the follower.

In another example embodiment, a bolt catch comprises a body having a forward surface and a rear surface spaced along a longitudinal axis. The body defines a slot extending therethrough, the slot being elongate along an axis parallel to the longitudinal axis. The forward surface has a first portion and a second portion. The first portion is spaced vertically above the slot along a vertical axis and spaced forwardly of the second portion. In one example, a bolt catch assembly comprises a bolt catch and a pin that extends through the slot. The bolt catch is movable relative to the pin along said axis parallel to the longitudinal axis. The bolt catch assembly further comprises a spring biasing against the forward surface of the body. In some embodiments, the body comprises, or is formed entirely from, die stamped sheet metal.

DETAILED DESCRIPTION

Figure 1:
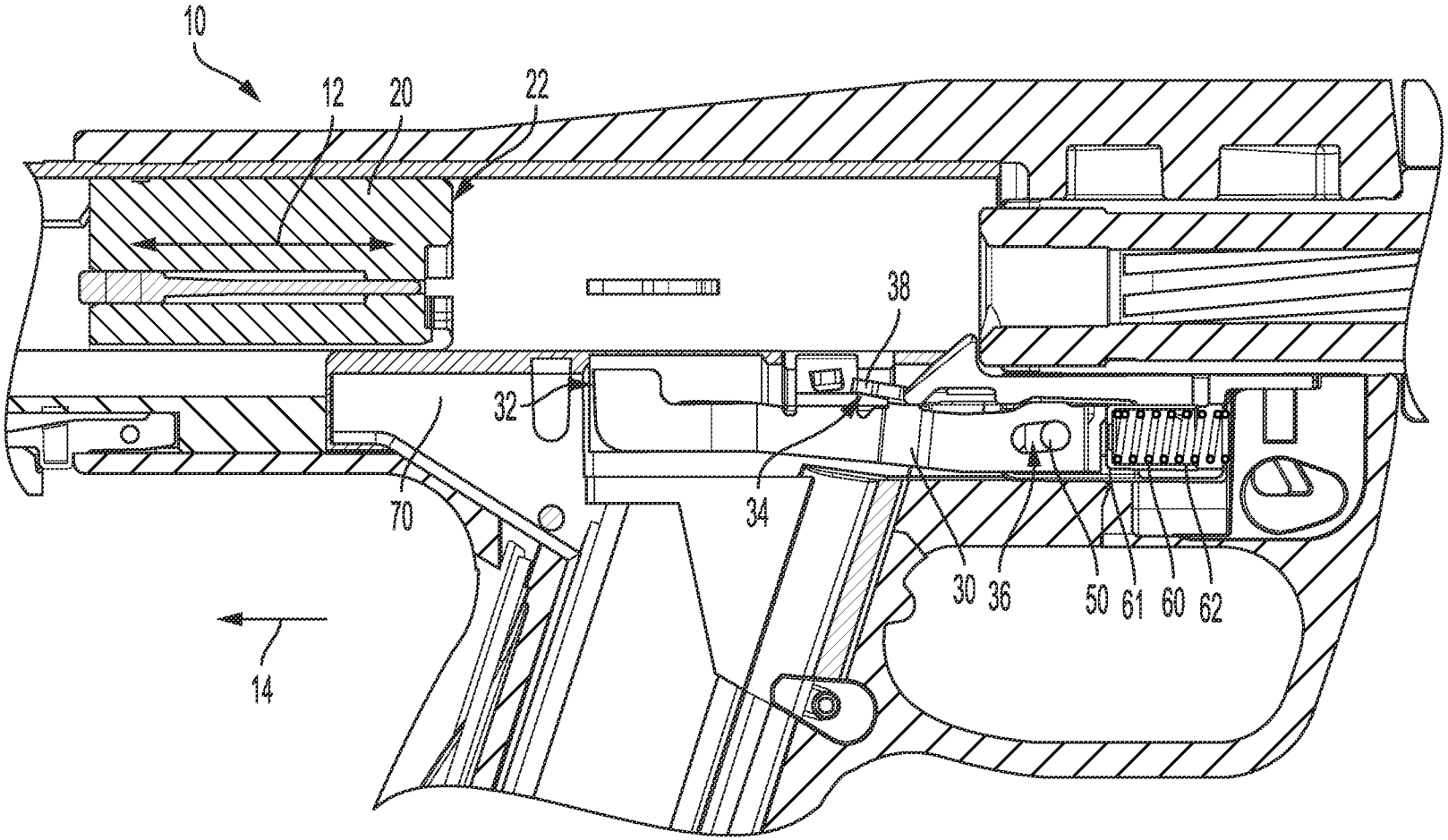
FIG. 1 is a sectional view of a firearm as disclosed herein, with the bolt catch in a stowed configuration.

FIG. 1 is a sectional view of an example firearm 10 according to the disclosure. In the example, the firearm is a carbine. However, it is contemplated that the firearm 10 can be provided in other configurations. As shown in FIG. 1, the bolt 20 is movable along a path of travel of a longitudinal axis 12 of the firearm about and between a first position (e.g., an open position) and a second position (e.g., a closed position). Bolt 20 has a forward surface 22, with forward surface 22 being in a first location with the bolt in the first position and a second location when bolt 20 is in the second position. The first location is spaced from the second location in a first direction 14.

Figure 2:
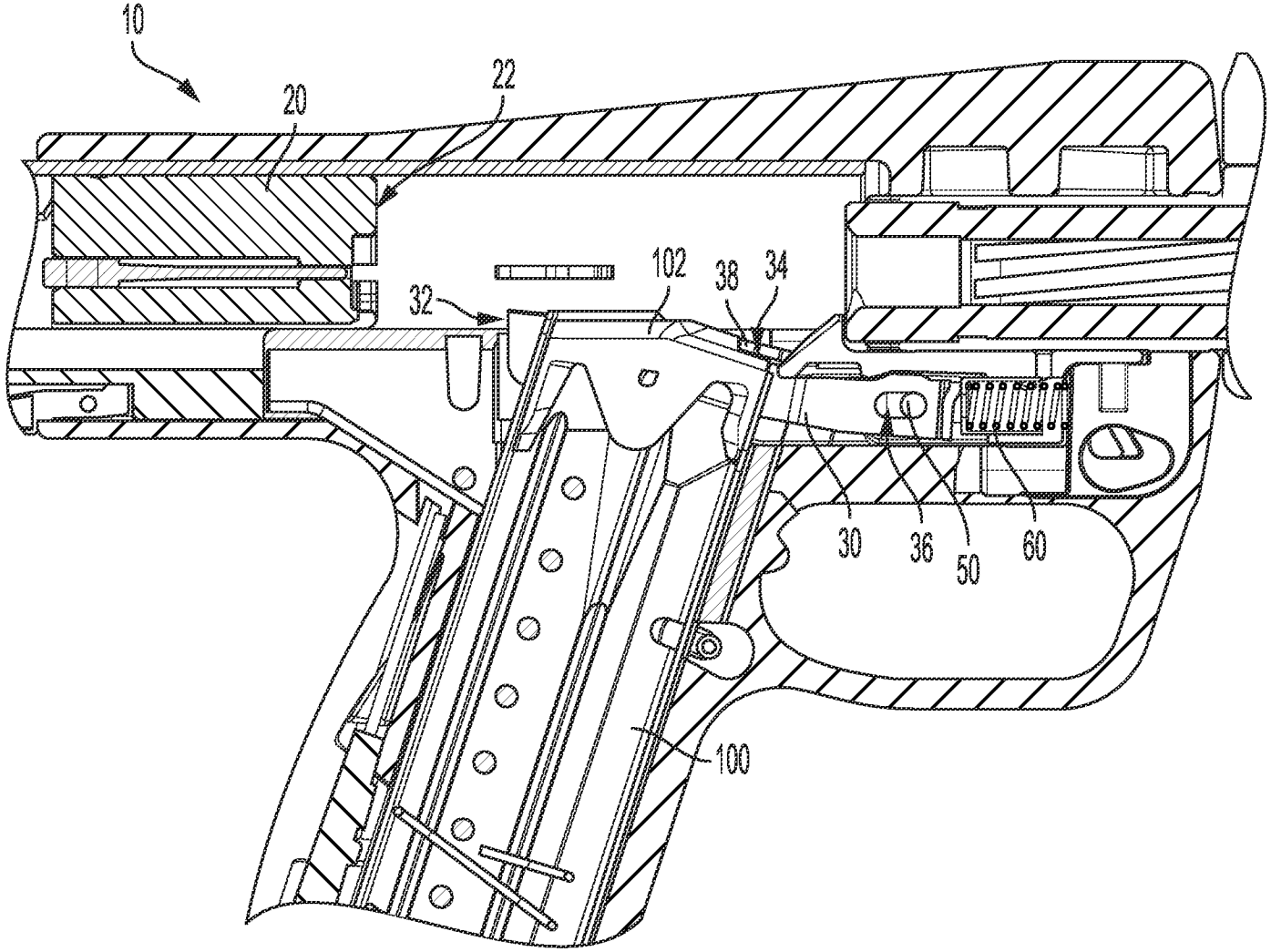
FIG. 2 is a sectional view of the firearm of FIG. 1, with the bolt catch in a catching configuration.

Referring also to FIG. 2, showing firearm 10 with an empty magazine and the bolt driven rearwardly by the action of the firearm, a bolt catch 30 is pivotable about a pin 50 between a stowed configuration (FIG. 1) and a catching configuration (FIG. 2). Bolt catch 30 has a first surface 32, in this example, a rear surface, that is in the path of travel of bolt 20 when bolt catch 30 is in the catching configuration and away from the path of travel when bolt catch 30 is in the stowed configuration. Bolt catch 30 has an inwardly extending tab 38 defining a second surface 34 that is configured to engage a follower 102 of a magazine 100 when the magazine is empty to pivot bolt catch 30 into the catching configuration.

Pin 50 extends through a slot 36 defined by bolt catch 30. The slot 36 is elongate along an axis 37. A spring 60 biases bolt catch 30 rearwardly (in first direction 14). In some embodiments, plunger 61 is disposed between, and in contact with, bolt catch 30 and spring 60. The plunger 61 provides a surface (e.g., a flat surface) that biases against the bolt catch 30. In this way, the spring 60 biases the bolt catch rearwardly via the plunger 61, the plunger 61 being in contact with the bolt catch 30. The plunger 61 is shown as a sleeve 62 that partially surrounds the spring. The spring 60 is illustrated as a coil spring. In various embodiments, the spring 60 can be embodied as a resilient body. For example, the spring 60 can comprise, or be embodied as, an elastomeric body (e.g., a cylindrical elastomeric body). Optionally, in these aspects, the plunger 61 can be omitted.

Figure 3:
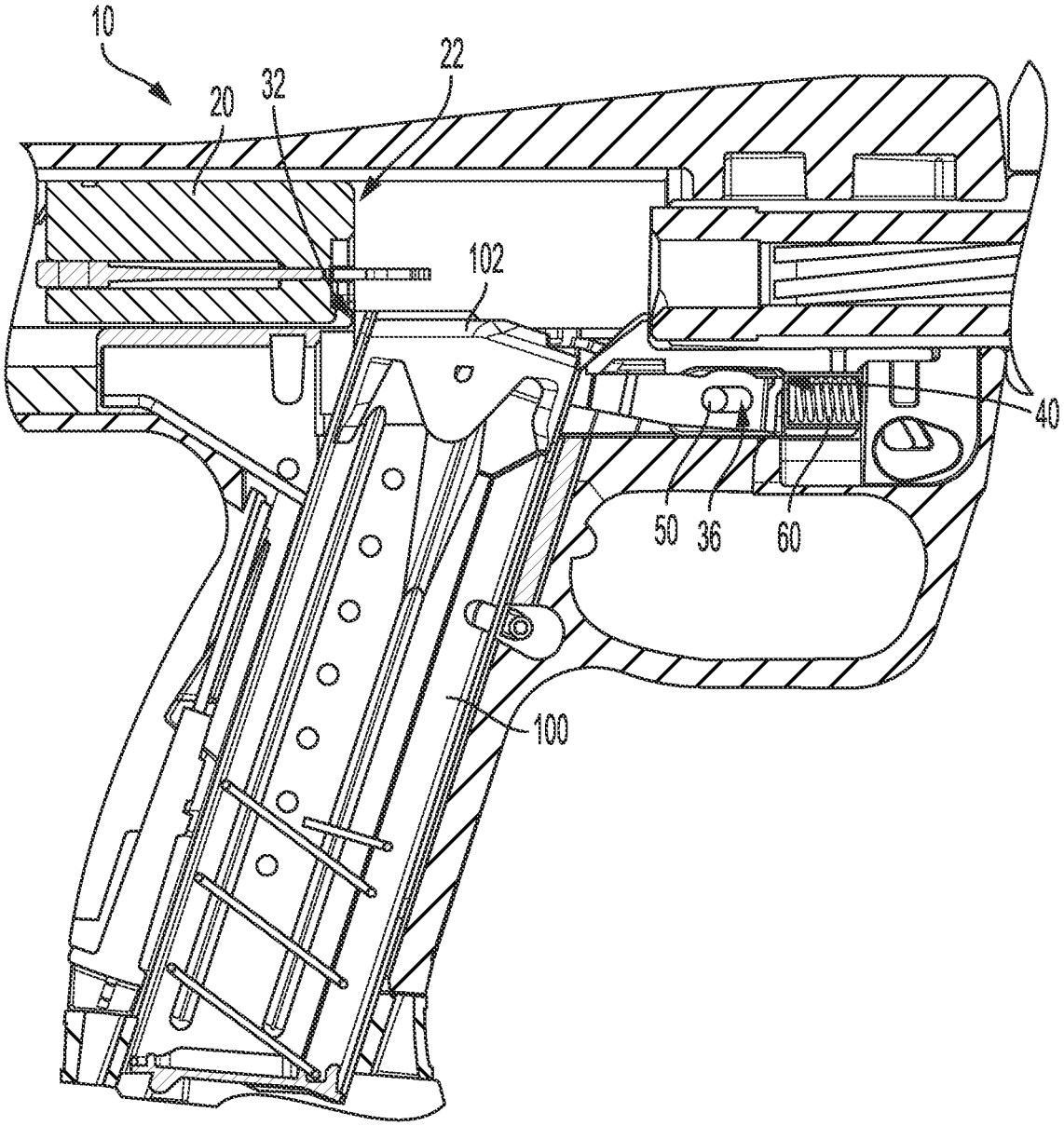
FIG. 3 is a sectional view of the firearm of FIG. 1, with the bolt engaging the bolt catch, moving the bolt catch to compress the spring.
Figure 4:
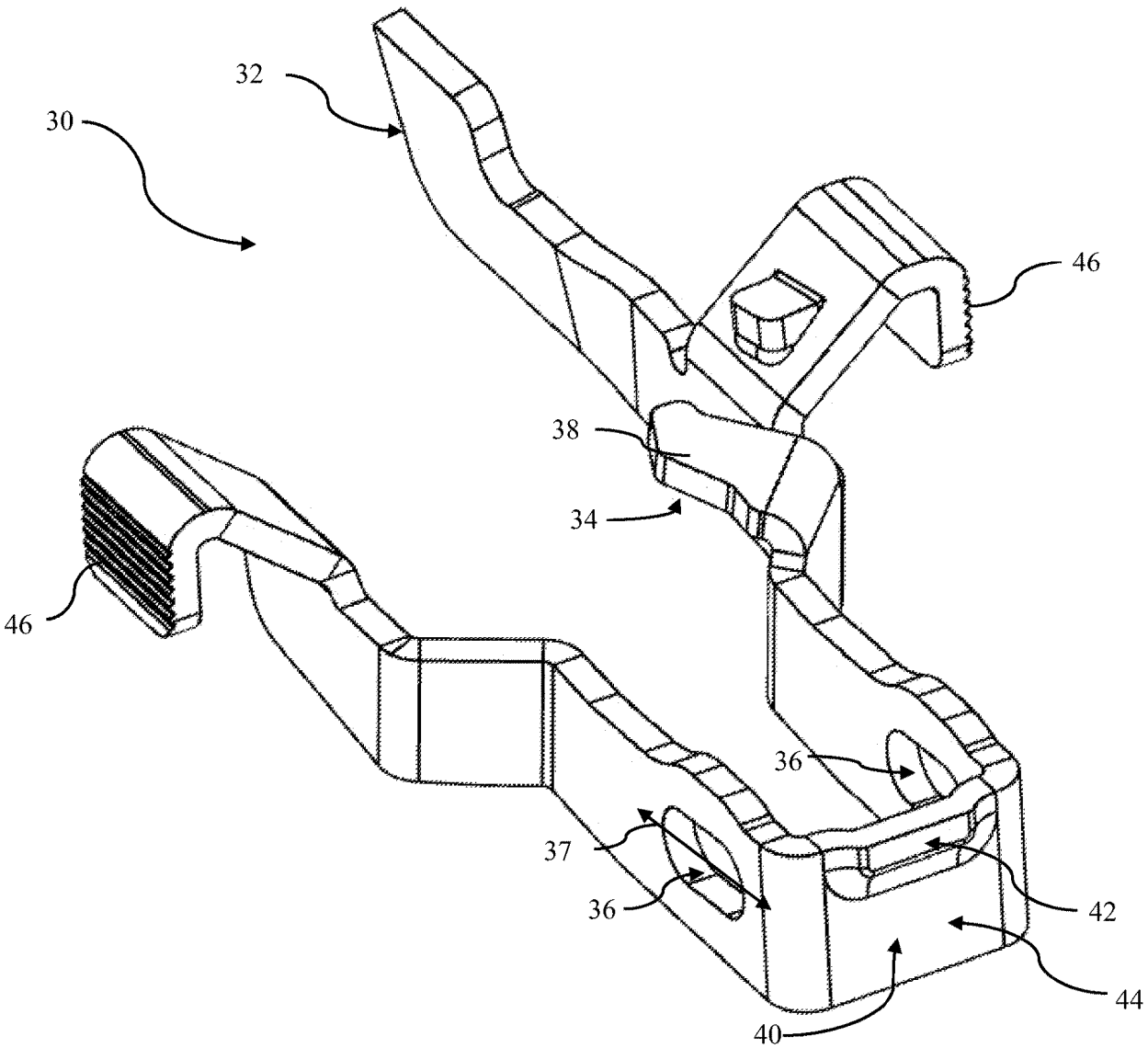
FIG. 4 is a top, front perspective view of the bolt catch of the firearm of FIG. 1.

Spring 60 also biases bolt catch 30 toward the stowed configuration (FIG. 1). Referring also to FIG. 4, bolt catch 30 has a forward surface 40 comprising a first portion 42 and a second portion 44. First portion 42 is positioned (optionally, spaced) vertically above second portion 44 and pin 50 and positioned forwardly of second portion 44. In one example embodiment, bolt catch 30 has a forwardly protruding lip (e.g., a forwardly protruding lip stamped into the bolt catch) to define the first portion 42. Thus, spring 60 biases against first portion 42 (and not second portion 44), thereby rotationally biasing bolt catch 30 toward the stowed configuration (counterclockwise in FIGS. 1-3). The flat surface of the plunger 61/sleeve 62 ensures that the first portion 42 is always the surface being acted upon by the force of the spring.

In use, as firearm 10 fires a last round of magazine 100, follower 102 of the empty magazine contacts tab 38, thereby lifting bolt catch 30 into the catching configuration. After expending the last shell, the bolt returns forwardly and contacts first surface 32 of bolt catch 30. Bolt 20 is a relatively massive component with high kinetic energy as it translates forwardly. As shown in FIG. 3, bolt 20 drives bolt catch 30 forwardly. In the catching configuration, axis 37 of slot 36 is parallel to the longitudinal axis 12 of the firearm 10 to permit the bolt catch 30 to slide relative to pin 50. Spring 60 compresses to absorb kinetic energy of bolt 20 to inhibit damage to bolt catch 30. That is, spring 60 is of sufficient force to absorb some or all of the momentum of bolt 20, thereby cushioning the impact on bolt catch 30.

Referring to FIGS. 1 and 4, firearm 10 has a grip body 70. Bolt catch 30 has protrusions 46 that extend outwardly of the grip body 70 on opposed sides to permit a user to move the bolt catch ambidextrously.

What is claimed is:

1. A firearm having a longitudinal axis and comprising:

a bolt configured for reciprocal motion about and between a first position and a second position along a path of travel along the longitudinal axis, the bolt having a forward surface, wherein the forward surface of the bolt is in a first location along the longitudinal axis when the bolt is in the first position, wherein the forward surface of the bolt is in a second location along the longitudinal axis when the bolt is in the second position, and wherein the first location of the forward surface of the bolt is spaced, in a first direction along the longitudinal axis, from the second location of the forward surface of the bolt;

a bolt catch movably mounted on the firearm, the bolt catch comprising:

a first surface that is configured to engage the bolt to retain the bolt in the first position;

a second surface that is configured to engage a follower of an empty magazine to position the bolt catch in a catching configuration in which the first surface is within the path of travel of the bolt between the first position and the second position; and an elongate slot that extends transversely through the bolt catch;

a pin that extends through the slot of the bolt catch, wherein the bolt catch is configured to pivot about the pin and slide relative to the pin, wherein the first surface of the bolt catch is spaced from the pin in the first direction along the longitudinal axis; and a spring that biases the bolt catch in the first direction, wherein, upon engagement between the bolt catch and the first surface of the bolt, the bolt catch is configured to slide relative to the pin to compress the spring.

2. The firearm of claim 1, wherein the second surface of the bolt catch is a rear surface of the bolt catch, and wherein the forward surface of the bolt is configured to engage the rear surface of the bolt catch.

3. The firearm of claim 1, wherein the spring is further configured to bias the bolt catch to a stowed configuration in which the first surface of the bolt catch is outside of the path of travel of the bolt.

4. The firearm of claim 3, wherein the bolt catch comprises a forward surface, wherein the forward surface has a first portion and a second portion, wherein the first portion is spaced vertically above the pin along a vertical axis and spaced forwardly of the second portion so that only the first portion is configured to bias against the spring when the bolt catch is in the stowed configuration.

5. The firearm of claim 1, wherein the bolt catch is a unitary structure.

6. The firearm of claim 1, wherein the bolt catch is formed from stamped metal.

7. The firearm of claim 1, wherein, when the bolt catch is in the catching configuration, the slot is elongate along an axis that is parallel to, or generally parallel to, the longitudinal axis.

8. The firearm of claim 1, wherein the bolt catch comprises an inwardly extending tab that defines the second surface.

9. The firearm of claim 1, further comprising a plunger disposed between, and in contact with, the bolt catch and the spring so that the spring biases the bolt catch in the first direction via contact with the plunger.

10. The firearm of claim 9, wherein the plunger comprises a sleeve that at least partially surrounds the spring.

11. The firearm of claim 1, further comprising a grip body, wherein the bolt catch comprises at least one protrusion that extends outwardly from the grip body to permit a user to move the bolt catch.

12. The firearm of claim 11, wherein the at least one protrusion comprises opposed protrusions that extend from opposite sides of the grip body.

13. The firearm of claim 1, wherein the firearm is a carbine.

14. The firearm of claim 1, further comprising the magazine comprising the follower.

15. The firearm of claim 1, wherein the spring comprises an elastomeric body.

16. A bolt catch comprising:

a die stamped sheet metal body having a forward surface and a rear surface spaced along a longitudinal axis, wherein the die stamped sheet metal body defines a slot extending therethrough, the slot being elongate along an axis parallel to the longitudinal axis, and wherein the forward surface has a first portion and a second portion, wherein the first portion is spaced vertically above the slot along a vertical axis and spaced forwardly of the second portion.

17. A bolt catch assembly comprising:

a bolt catch comprising:

a die stamped sheet metal body having a forward surface and a rear surface spaced along a longitudinal axis, wherein the die stamped sheet metal body defines a slot extending therethrough, the slot being elongate along an axis parallel to the longitudinal axis;

a pin extending through the slot, wherein the bolt catch is movable relative to the pin along said axis parallel to the longitudinal axis; and a spring biasing against the forward surface of the die stamped sheet metal body.

* * * * *